US009472850B2

(12) United States Patent
Chiu

(10) Patent No.: US 9,472,850 B2
(45) Date of Patent: Oct. 18, 2016

(54) ANTENNA APPARATUS

(71) Applicant: GETAC TECHNOLOGY CORPORATION, Hsinchu County (TW)

(72) Inventor: Shang-Ming Chiu, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 65 days.

(21) Appl. No.: 14/474,066

(22) Filed: Aug. 29, 2014

(65) Prior Publication Data

US 2015/0295318 A1 Oct. 15, 2015

(30) Foreign Application Priority Data

Apr. 10, 2014 (CN) ..... 2014 1 0141349

(51) Int. Cl.
*H01Q 9/00* (2006.01)
*H01Q 9/04* (2006.01)
*H01Q 1/24* (2006.01)
*H01Q 9/42* (2006.01)
*H01Q 19/00* (2006.01)

(52) U.S. Cl.
CPC ..... *H01Q 9/0442* (2013.01); *H01Q 1/245* (2013.01); *H01Q 9/42* (2013.01); *H01Q 19/005* (2013.01)

(58) Field of Classification Search
CPC ..... H01Q 1/243
USPC ..... 343/745
See application file for complete search history.

(56) References Cited

FOREIGN PATENT DOCUMENTS

TW M456027 6/2013

*Primary Examiner* — Graham Smith

(57) ABSTRACT

An antenna apparatus is provided. A control unit adjusts an adjustment voltage outputted to a parasitic ground antenna unit according to a first voltage generated by a sensing unit and a second voltage generated by a frequency detecting unit.

10 Claims, 2 Drawing Sheets

ANTENNA APPARATUS

BACKGROUND OF THE INVENTION

1. Field of the Invention

The invention relates to an electronic apparatus, and more particularly, to an antenna apparatus.

2. Description of Related Art

In keeping pace with progress in communication technology, application of the wireless communication technology for hi-tech products has been increasing and related communication products have become diversified. The hi-tech products, such as a personal digital assistant (PDA), a global positioning system (GPS) and so on, all fall within a scope of wireless communication. As the consumer functional requirements for communication products have become increasingly higher in recent years, communication products with various designs and functions are continuously brought to market. Recently, computer network products with wireless communication capability are especially popular in demand as a hot trend.

For wireless communication products, the most crucial point is a design of an antenna, because the design quality of the antenna will influence a communication quality thereof. Generally, electromagnetic wave radiated by the antenna is usually harmful to human health. Accordingly, Federal Communications Commission (FCC) has formulated a specific absorption ratio (hereinafter, referring to as SAR) value for electronic apparatuses, thereby restricting a maximum amount of energy allowable for an electronic apparatus to emit or radiate.

However, in order to make SAR value passing its testing regulation, most of conventional electronic apparatuses simply lowers efficiency of the antenna so that the SAR value may be maintained within a testing range for safety measure, which affects the communication quality of the electronic apparatus. Therefore, it has become a major issue in designing the electronic apparatuses as how to satisfy the safety measure defined by the SAR value while maintaining the communication quality of the electronic apparatus.

SUMMARY OF THE INVENTION

The invention is directed to an antenna apparatus capable of effectively making an antenna to satisfy the safety measure defined by the SAR value.

The antenna apparatus of the invention includes a main antenna, a parasitic ground antenna unit, a radio frequency signal processing unit, a sensing unit, a frequency detecting unit and a control unit. The main antenna has a feed point. The radio frequency signal processing unit is electrically connected to the feed point, so as to generate or receive a radio frequency signal. The sensing unit outputs a first voltage, and changes a voltage value of the first voltage according to variations of a distance between the sensing unit and a human body. The frequency detecting unit detects an emitting/receiving frequency of the main antenna, and generates a second voltage in response to the emitting/receiving frequency of the main antenna. The control unit is coupled to the parasitic ground antenna unit, the sensing unit and the frequency detecting unit, and adjusts an adjustment voltage according to the first voltage and the second voltage, so as to adjust a resonance frequency of the parasitic ground antenna unit.

In an embodiment of the invention, the control unit further performs a voltage division to the first voltage and the second voltage to generate the adjustment voltage.

In an embodiment of the invention, the control unit includes a first resistor and a second resistor. The second resistor is coupled in series together with the first resistor between the sensing unit and the frequency detecting unit. The third resistor is coupled between a connection point of the first resistor and the second resistor and a ground, and the adjustment voltage is generated on a connection point of the first resistor, the second resistor and the third resistor.

In an embodiment of the invention, the parasitic ground antenna unit includes a parasitic ground antenna, an inductor and a variable capacitor. The inductor is coupled between the parasitic ground antenna and the control unit. The variable capacitor is coupled between the parasitic ground antenna and a ground.

In an embodiment of the invention, the control unit is a chip.

In an embodiment of the invention, the sensing unit includes a capacitor, a capacitance-to-voltage converting unit and an inverter. The capacitance-to-voltage converting unit is coupled to the capacitor, and converts a capacitance of the capacitor into a voltage signal. The inverter is coupled to the capacitance-to-voltage converting unit, and inverts the voltage signal outputted by the capacitance-to-voltage converting unit to output the first voltage.

In an embodiment of the invention, the capacitor includes a copper foil.

In an embodiment of the invention, the frequency detecting unit includes a coupler, a power converting unit and an inverter. The coupler measures a power of the radio frequency signal outputted by the radio frequency signal processing unit. The power converting unit is coupled to the coupler, and converts the power measured by the coupler into a voltage signal. The inverter is coupled to the power converting unit, and inverts the voltage signal outputted by the power converting unit to output the second voltage.

In an embodiment of the invention, the control unit further controls the frequency detecting unit to adjust the outputted second voltage according to the first voltage, so as to adjust the resonance frequency of the parasitic ground antenna unit.

In an embodiment of the invention, the main antenna is a planar inverted F antenna.

Based on above, the invention utilizes the control unit to adjust the adjustment voltage outputted to the parasitic ground antenna unit according to the first voltage generated by the sensing unit and the second voltage generated by the frequency detecting unit, so as to adjust the resonance frequency of the parasitic ground antenna unit, thereby improving the communication quality of the electronic product applying the antenna apparatus. The first voltage is generated by the sensing unit in response to the distance between itself and the human body, and the second voltage is generated by the frequency detecting unit in response to the emitting/receiving frequency of the antenna.

To make the above features and advantages of the disclosure more comprehensible, several embodiments accompanied with drawings are described in detail as follows.

DESCRIPTION OF THE EMBODIMENTS

Figure 1:
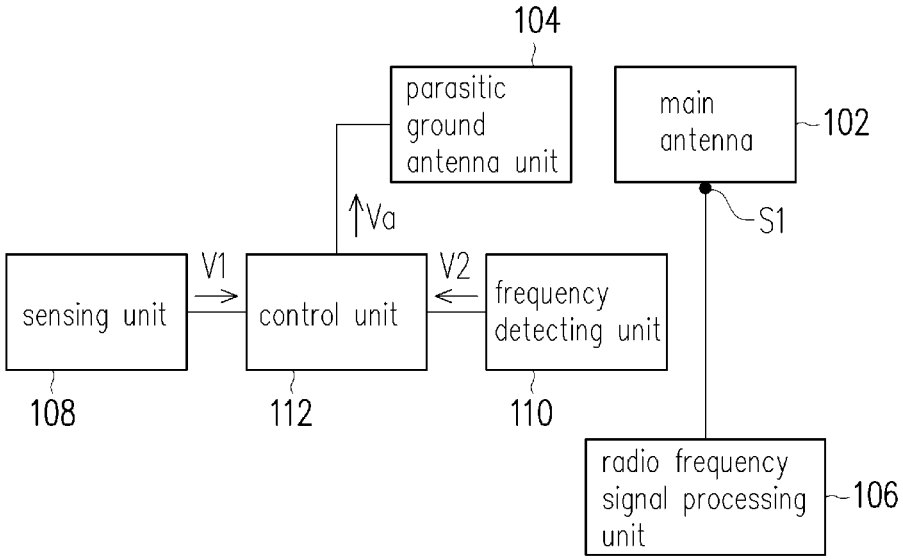
FIG. 1 illustrates a schematic diagram of an antenna apparatus according to an embodiment of the invention.

Referring to FIG. 1, FIG. 1 illustrates a schematic diagram of an antenna apparatus according to an embodiment of the invention. The antenna apparatus includes a main antenna 102, a parasitic ground antenna unit 104, a radio frequency signal processing unit 106, a sensing unit 108, a frequency detecting unit 110 and a control unit 112. The radio frequency signal processing unit 106 is coupled to the main antenna 102, and the control unit 112 is coupled to the parasitic ground antenna unit 104, the sensing unit 108 and the frequency detecting unit 110. The main antenna 102 has a feed point S1. The main antenna 102 may be, for example, a planar inverted F antenna, but the invention is not limited thereto. The radio frequency signal processing unit 106 is electrically connected to the feed point S1, and emits a radio frequency signal as electromagnetic wave through the main antenna 102, or receives the radio frequency signal through the main antenna 102.

The sensing unit 108 is capable of sensing a distance between itself and a human body, and outputting a first voltage V1 in response to the distance. That is, the first voltage V1 outputted by the sensing unit 108 may be changed with variations of the distance between the sensing unit 108 and the human body. The frequency detecting unit 110 is capable of detecting an emitting/receiving frequency of the main antenna 102, and generating a second voltage V2 in response to the emitting/receiving frequency of the main antenna 102. In addition, the control unit 112 may be implemented by using a chip, which is capable of adjusting an adjustment voltage Va outputted to the parasitic ground antenna unit 104 according to the first voltage V1 and the second voltage V2, so as to adjust a resonance frequency of the parasitic ground antenna unit 104. For instance, the control unit 112 may output the adjustment voltage Va to the parasitic ground antenna unit 104 according to the first voltage V1 outputted by the sensing unit 108 (i.e., according to the distance between the sensing unit 108 and the human body) and the second voltage V2, so as to adjust the resonance frequency of the parasitic ground antenna unit 104. As a result, the emitting/receiving frequency of the main antenna 102 may generate a frequency shifting for accomplishing a purpose of lowering the SAR value, thereby improving a communication quality of an electronic product applying the antenna apparatus.

Figure 2:
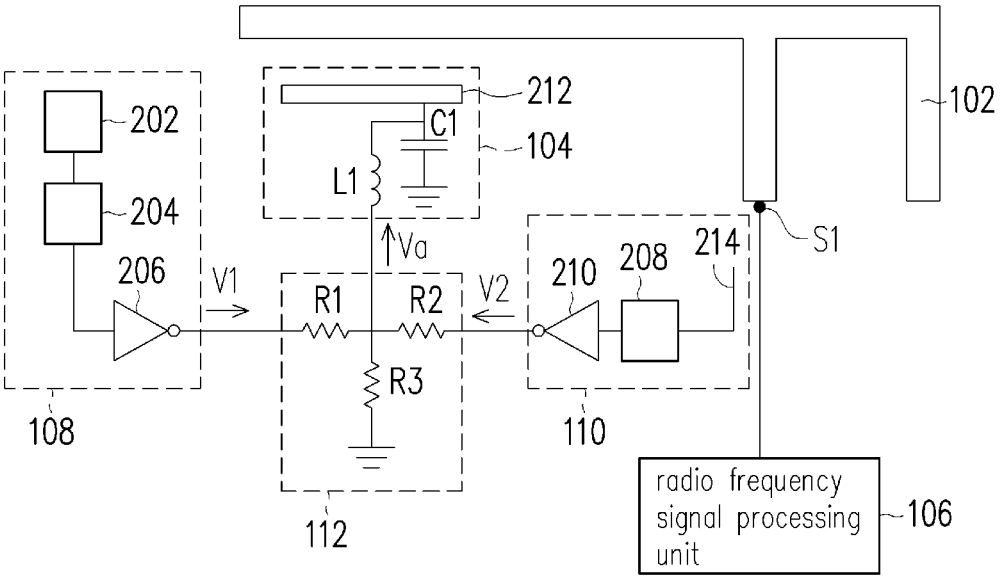
FIG. 2 illustrates a schematic diagram of an antenna apparatus according to another embodiment of the invention.

Referring to FIG. 2, FIG. 2 illustrates a schematic diagram of an antenna apparatus according to another embodiment of the invention. In the present embodiment, the main antenna 102 is a planar inverted F antenna, and the sensing unit 108 includes a capacitor 202, a capacitance-to-voltage converting unit 204 and an inverter 206. The capacitance-to-voltage converting unit 204 is coupled between the capacitor 202 and the inverter 206, and the inverter 206 is further coupled to the control unit 112. The capacitor 202 may be implemented by a copper foil for example, but the invention is not limited thereto. The capacitor 202 may result in different capacitances according to a proximity degree between the human body and itself, and the capacitance-to-voltage converting unit 204 may convert the capacitance of the capacitor into a voltage signal, and then invert the voltage signal through the inverter 206 to generate the first voltage V1.

In the present embodiment, the frequency detecting unit 110 includes a power converting unit 208, an inverter 210 and a coupler 214. The power converting unit 208 is coupled to the inverter 210 and the coupler 214, and the inverter 210 is further coupled to the control unit 112. The coupler 214 is capable of measuring a power of the radio frequency signal outputted or received by the radio frequency signal processing unit 106, and the power converting unit 208 is capable of converting the power measured by the coupler 214 into a voltage signal to be inverted by the inverter 210 to generate aforesaid second voltage V2.

The control unit 112 is capable of performing a voltage division to the first voltage V1 and the second voltage V2 to generate the adjustment voltage Va. In addition to the chip, the control unit 122 may also be implemented by a voltage division circuit as shown in the embodiment of FIG. 2. In the embodiment of FIG. 2, the control unit 112 includes resistors R1 to R3. The resistors R1 and R2 are coupled in series between the inverter 206 and the inverter 210 (i.e., coupled in series between the sensing unit 108 and the frequency detecting unit 110), and the resistor R3 is coupled between a connection point of the resistors R1 and R2 and a ground. After the voltage division is performed to the first voltage V1 and the second voltage V2 through the resistors R1 to R3, the adjustment voltage Va may be generated on a connection point of the resistors R1, R2 and R3. Accordingly, by properly adjusting resistances of the resistors R1, R2 and R3, an deal communication quality may be provided to the electronic product applying the antenna apparatus.

The parasitic ground antenna unit 104 includes a parasitic ground antenna 212, an inductor L1 and a variable capacitor C1. The inductor L1 is coupled between the parasitic ground antenna 212 and the control unit 112, and the variable capacitor C1 is coupled between the parasitic ground antenna 212 and a ground. The inductor L1 and the variable capacitor C1 may change a voltage applied to the parasitic ground antenna 212 in response to variations of the adjustment voltage Va. Accordingly, the parasitic ground antenna 212 may affect the main antenna 102, so that the emitting/receiving frequency of the main antenna 102 may generate the frequency shifting.

For instance, a capacitance of the capacitor 202 becomes greater when the human body is closing to the capacitor 202, thereby increasing a voltage value of the voltage signal outputted by the capacitance-to-voltage converting unit 204. When the voltage value of the voltage signal outputted by the capacitance-to-voltage converting unit 204 is increased to reach a cut-off voltage of the inverter 206, the inverter 206 is enabled to decrease the first voltage V1, increase the capacitance of the variable capacitor C1, and increase capacitive character of the main antenna 102 and the parasitic ground antenna 212. As a result, a frequency resonance point of the main antenna 102 is decreased and the frequency shifting is generated, so as to accomplish the purpose of decreasing a high frequency power. Further, when an outputting power of the radio frequency signal processing unit 106 is greater, the voltage converted and outputted by the power converting unit 208 is also greater. Accordingly, through inversion of the inverter 210, the second voltage V2 may also be decreased, the capacitance of the variable capacitor C1 may be increased, and the capacitive character of the parasitic ground antenna of the main antenna is increased. As a result, a frequency resonance point of the main antenna 102 is decreased to accomplish the purpose of decreasing the high frequency power.

Figure 3:
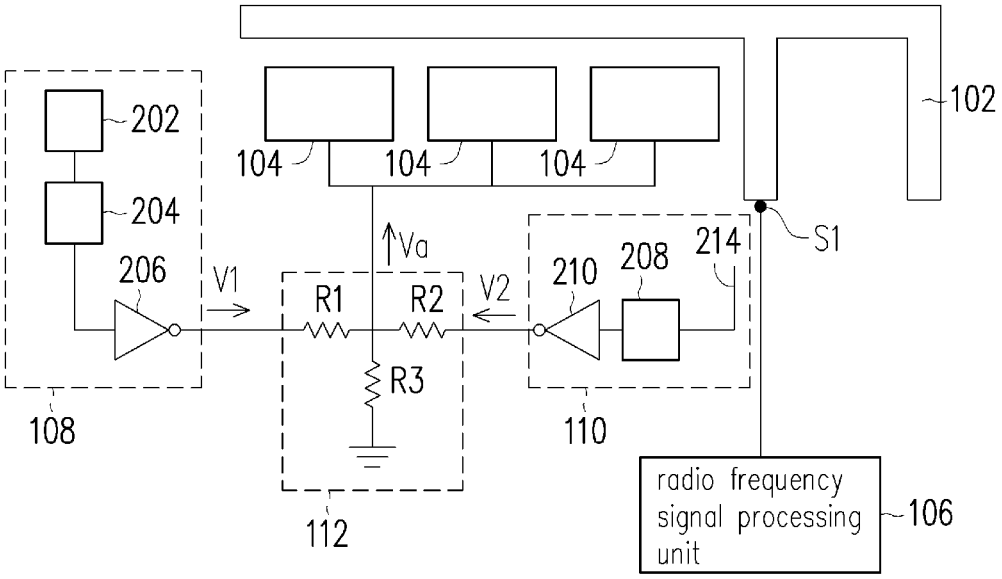
FIG. 3 illustrates a schematic diagram of an antenna apparatus according to another embodiment of the invention.

It should be noted that, although only one parasitic ground antenna unit 104 is used to describe the antenna apparatus in the foregoing embodiment for example, an amount of the parasitic ground antenna unit 104 is not limited only to be one in practical applications. Designers may increase the amount of the parasitic ground antenna unit 104 according to practical demands, and have the parasitic ground antenna units 104 disposed at proper positions, so as obtain the desired frequency shifting for the main antenna 102. For example, FIG. 3 illustrates a schematic diagram of an antenna apparatus according to another embodiment of the invention. In FIG. 3, three parasitic ground antenna units 104 are utilized to affect the emitting/receiving frequency of the main antenna 102, and the implementation of each of the parasitic ground antenna units 104 is identical to that depicted in FIG. 2. For maintaining clearly of the drawing, said implementation is not repeatedly illustrated herein.

In summary, according to the embodiments of the invention, the sensing unit generates the first voltage in response to the distance between itself and the human body, the frequency detecting unit generates the second voltage in response to the emitting/receiving frequency, and the control unit adjusts the adjustment voltage outputted to the parasitic ground antenna unit according to the first voltage generated by the sensing unit and the second voltage generated by the frequency detecting unit. As a result, the resonance frequency of the parasitic ground antenna unit may be adjusted to improve the communication quality of the electronic product applying the antenna apparatus.

What is claimed is:

1. An antenna apparatus, comprising:

a main antenna, having a feed point;

a parasitic ground antenna unit, wherein the main antenna is electromagnetically coupled to the parasitic ground antenna to adjust the frequency of the main antenna when the frequency of the parasitic antenna is adjusted;

a radio frequency signal processing unit, electrically connected to the feed point, generating or receiving a radio frequency signal;

a sensing unit, outputting a first voltage, and changing a voltage value of the first voltage according to variations of a distance between the sensing unit and a human body;

a frequency detecting unit, detecting an emitting/receiving frequency of the main antenna, and generating a second voltage in response to the emitting/receiving frequency of the main antenna; and a control unit, coupled to the parasitic ground antenna unit, the sensing unit and the frequency detecting unit, and adjusting an adjustment voltage according to the first voltage and the second voltage, so as to adjust a resonance frequency of the parasitic ground antenna unit.

2. The antenna apparatus of claim 1, wherein the control unit further performs a voltage division to the first voltage and the second voltage, so as to generate the adjustment voltage.

3. The antenna apparatus of claim 2, wherein the control unit comprises:

a first resistor;

a second resistor, coupled in series together with the first resistor between the sensing unit and the frequency detecting unit; and a third resistor, coupled between a connecting point of the first resistor and the second resistor and a ground, and the adjustment voltage being generated on a connection point of the first resistor, the second resistor and the third resistor.

4. The antenna apparatus of claim 2, wherein the parasitic ground antenna unit comprises:

a parasitic ground antenna;

an inductor, coupled between the parasitic ground antenna and the control unit; and a variable capacitor, coupled between the parasitic ground antenna and a ground.

5. The antenna apparatus of claim 1, wherein the control unit is a chip.

6. The antenna apparatus of claim 1, wherein the sensing unit comprises:

a capacitor;

a capacitance-to-voltage converting unit, coupled to the capacitor, and converting a capacitance of the capacitor into a voltage signal; and an inverter, coupled to the capacitance-to-voltage converting unit, and inverting the voltage signal outputted by the capacitance-to-voltage converting unit to output the first voltage.

7. The antenna apparatus of claim 6, wherein the capacitor comprises a copper foil.

8. The antenna apparatus of claim 1, wherein the frequency detecting unit comprises:

a coupler, measuring a power of the radio frequency signal outputted by the radio frequency signal processing unit;

a power converting unit, coupled to the coupler, and converting the power measured by the coupler into a voltage signal; and an inverter, coupled to the power converting unit, and inverting the voltage signal outputted by the power converting unit to output the second voltage.

9. The antenna apparatus of claim 1, wherein the control unit further controls the frequency detecting unit to adjust the outputted second voltage according to the first voltage, so as to adjust the resonance frequency of the parasitic ground antenna unit.

10. The antenna apparatus of claim 1, wherein the main antenna is a planar inverted F antenna.

* * * * *